United States Patent [19]

Yasuda et al.

[11] 3,983,445

[45] Sept. 28, 1976

[54] PLASMA DISPLAY PANEL INCLUDING ELECTRODES FOR TRAPPING IONS

[75] Inventors: Susumu Yasuda; Takao Mimitsuka, both of Tokyo, Japan

[73] Assignee: Nippon Electric Company, Ltd., Tokyo, Japan

[22] Filed: May 22, 1975

[21] Appl. No.: 579,849

[30] Foreign Application Priority Data

May 22, 1974 Japan ..... 49-57441

[52] U.S. Cl. ..... 313/485; 313/217; 313/220

[51] Int. Cl.[2] ..... H01J 63/04

[58] Field of Search ..... 313/188, 201, 217, 220, 313/485, 486, 487

[56] References Cited

UNITED STATES PATENTS 3,886,395 5/1975 Eukushima et al. ..... 313/220 X

*Primary Examiner*—R. V. Rolinec
*Assistant Examiner*—Darwin R. Hostetter
*Attorney, Agent, or Firm*—Hopgood, Calimafde, Kalil, Blaustein & Lieberman

[57] ABSTRACT

A plasma display panel is provided with front and rear boards each having a plurality of electrode members, respectively. The front and rear boards are spaced apart to define a discharge space filled with an ionizable gas. The front board is equipped with a front glass plate including a fluorescent or phosphorescent element set on its inside surface, and a central plate having a number of holes therethrough. The electrode members of the front board are affixed by a coating to an inside surface of the central plate. The fluorescent or phosphorescent elements are placed at the rear of the electrode members on the central plate.

13 Claims, 13 Drawing Figures

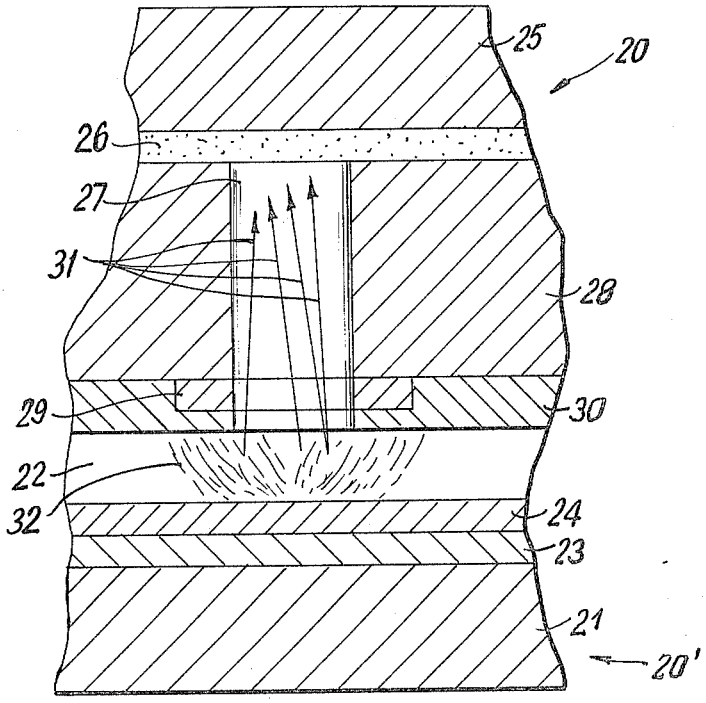
FIG. 3
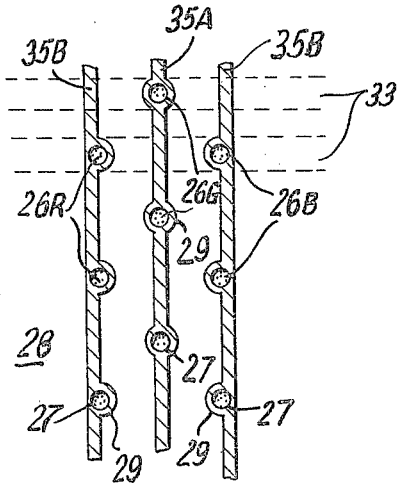
FIG. 5
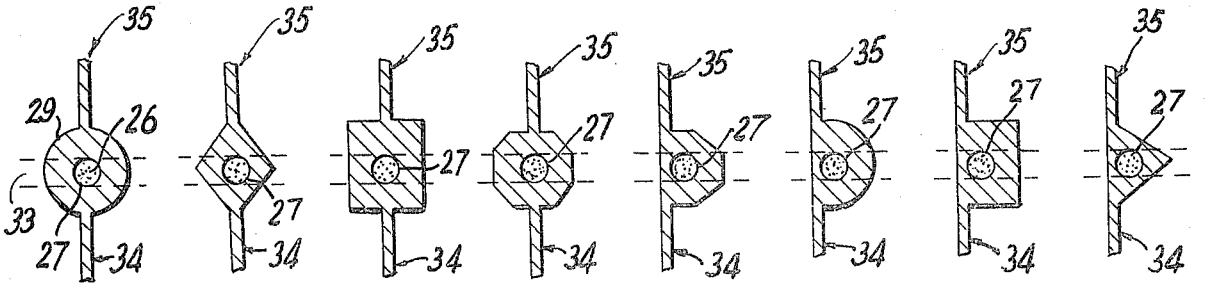
FIG.4a FIG.4c FIG.4e FIG.4g
FIG.4b FIG.4d FIG.4f FIG.4h

PLASMA DISPLAY PANEL INCLUDING ELECTRODES FOR TRAPPING IONS

BACKGROUND OF THE INVENTION

This invention relates to a plasma display panel and, more particularly, a multicolor plasma display panel for forming a color display.

In general, a plasma display panel of the type discussed here includes front and rear spaced apart boards and utilizes the space defined between two boards as a discharge space. Further, each of the boards is provided with a holder plate, a number of stripe-like electrodes coated on a surface of the holder plate facing the discharge space, a dielectric layer covering the electrodes and a fluorescent or phosphorescent layer set coated on the dielectric layer. The fluorescent or phosphorescent body of the layer set generally employs means to produce the photo-luminescence or cathode-luminescence due to excitation of the ultraviolet ray or electron beam.

In such a plasma display panel, an ionizable gas such as neon contained in the discharge space is discharged by electric power supplied to the tripe-like electrodes of two boards. Ultraviolet rays and free electrons are produce in the space due to discharge of the ionizable gas. The fluoresent or phosphorescent body (which is also called a luminescent body) is excited due to the ultraviolet rays and electron beams.

Thus, the plasma display panel of this type can display any color corresponding to a luminescent body.

The luminescence of the body is remarkably reduced when the plasma display panel is driven by alternating current (A.C.), that is, the polarity of the discharge is inverted at every discharge. Ions produced in the discharged gas bombard the luminescent body facing the discharge space upon every other discharge. Therefore, a remarkable reduction such as that caused by ion baking takes place on the luminescent body due to ion bombardment. The luminescence intensity is rapidly decreased to one half of the initial intensity in about 2000 to 3000 hours.

SUMMARY OF THE INVENTION

It is an object of this invention to provide a plasma display panel having a long life time. It is another object of this invention to provide a plasma display panel suitable for multicolor display.

It is still another object of this invention to provide a plasma display panel for which it is possible to reduce bombardment of ions produced in the discharge space.

As described hereinabove, a plasma display panel comprises front and rear boards spaced apart to define a discharge space filled with an ionizable gas. In accordance with this invention, the front board is provided with a luminescent layer set coated on its inside surface, and a central plate having a number of through holes to be mounted on the inside surface of the front plate. In addition, a plurality of electrodes are coated around each of the through holes on an inside surface of the central plate to form a plurality of electrode members. Moreover, the luminescent layer set is located at the rear of the electrode members on the central plate.

BRIEF DESCRIPTION OF THE DRAWING

FIG. 3 illustrates the operation of the plasma display panel shown in FIG. 2;

FIGS. 4(*a*) to 4(*h*) are plane views of several types of electrodes suitable for this invention taken along the line *a—a* of FIG. 2; and FIG. 5 is a plane view of a plasma display panel according to another embodiment of this invention.

DESCRIPTION OF THE PREFERRED EMBODIMENT

Figure 1A:
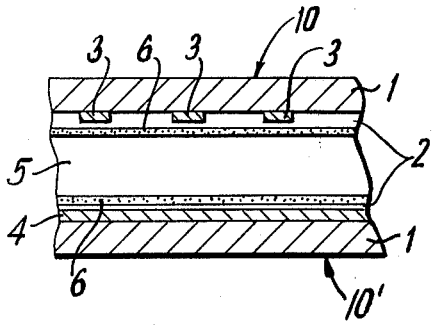
(PRIOR ART) FIG. 1a
FIGS. 1(*a*) and 1(*b*) are partial sectional views of conventional devices.
Figure 1B:
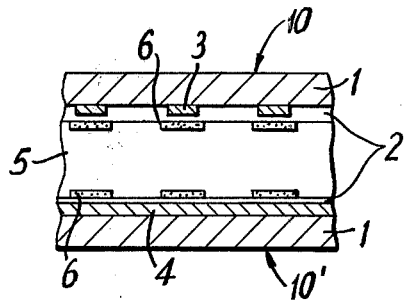
(PRIOR ART) FIG. 1b

Referring to FIGS. 1(*a*) and 1(*b*), a plasma display panel has spaced apart front and rear boards 10 and 10'. A discharge space 5 is defined between both of the boards 10, 10'. Each of the boards 10, and 10' includes a holder plate 1, and stripe-like electrode members 3 and 4 coated on a surface of each of the holder plates 10 and 10' facing inwardly toward the discharge space 5. The electrode members 3 and 4 are respectively covered by dielectric layers 2, such as lead glasses. The electrode members 3 and 4 are arranged to cross each other perpendicularly, and the discharge space 5 is filled with an ionizable gas. The outer peripheries of the boards are hermetically sealed by solder glasses (not shown). In FIG. 1(*a*) each of a plurality of luminescent bodies set 6 is coated on all the surface of the dielectric layers 2, while in FIG. 1(*b*) it is only coated at cross portions of two stripe-like electrode members 3,4 on the dielectric layers 2. However, in these conventional embodiments, the luminescent body set 6 faces the discharge space 5. Accordingly, it is difficult to avoid ion bombardment when the ionizable gas is discharged in the space 5.

Specifically, reduction of the luminescence in the luminescent body set 6 is considerable when the plasma display panel is driven by alternating current.

When a positive potential is supplied to the electrode member 3 while a negtive potential or ground is supplied to another electrode member 4, and the potential between the electrode members 3 and 4 is raised to a value sufficient for discharge of the ionizable gas, the ionizable gas is discharged in the discharge space. The luminescent body set 6 is excited by rays and charged particles in a discharged path and peculiar spectra corresponding to the selected luminescent body are produced therefrom.

Electrons within the plasma produced are carried toward the positive stripe-like electrode member 3 while ions are moved toward the negative stripe-like electrode member 4. Electrons and ions are respectively charged up on the luminescent body sets 6 mounted on the electrode members 3 and 4. The direction of the electric field that occurs in the discharge space due to electric charges is the reverse of that supplied to the stripe-like electrode members. Consequently, when the electric field within the space 5 is less than the discharge potential, the discharge is stopped therein.

On the other hand, when any suitable negative potential (or the ground potential) is supplied to the stripe-like electrode member 3 while a positive potential is applied to the stripe-like electrode member 4 a reverse electric field occurs in the discharge space of this half cycle of driving voltage. Therefore, the electric field due to these charges is added to the supplied electric field. When the potential in the discharge space attributable to both the electric fields reaches to the firing potential, the gas is discharged in the space.

The ultraviolet rays and charged particles from the discharge path excite the luminescent body sets 6. Thus, the luminescent body sets 6 are not only bombarded by the ultraviolet rays but they are also bombarded by charged particles like ions.

Figure 2:
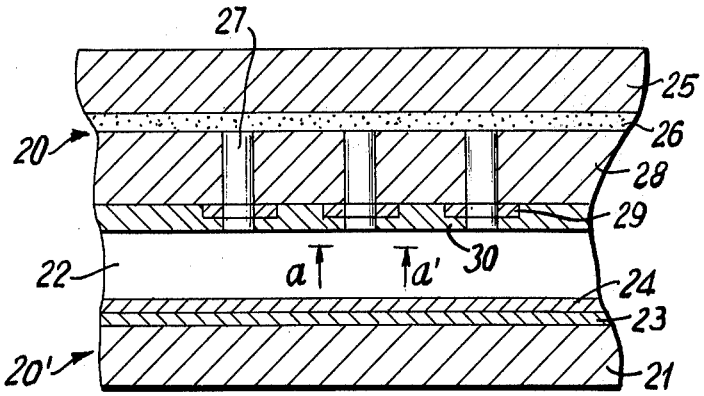
FIG. 2 is a partial sectional view of a plasma display panel according to one embodiment of this invention.

Referring to FIG. 2, a plasma display panel is provided with two boards 20, 20' spaced apart to define a discharge space between them. The board 20' which is a rear plate of the panel includes a holder plate 21, a plurality of stripe-like electrodes 23 coated on a surface of the holder plate 21 facing the discharge space 22, and a dielectric layer coated onto the stripe-like electrodes 23.

The board 20 that is a front plate comprises a transparent glass plate 25, and a luminescent body set 26 such as the fluorescent or phosphorescent body directly coated on a surface of the glass plate 25 facing the discharge space 22. A central plate 28 having a plurality of through holes 27 is mounted over the luminescent body set 26. Further, on the central plate 28 a number of electrodes 29 are coated around the through holes 27, and a plurality of electrodes 29 are connected to each other by conductive lines (not shown) to form a plurality of electrode members arranged in rows or columns. The electrodes 29 can be driven at every row or column of the electrodes 29. The electrodes 29 and the conductive lines are covered with an insulating layer 30. The space 22 between the boards 20 and 20' and the through holes 27 is filled with an ionizable gas such as neon, xenon or a mixture thereof. The outer peripheries of the boards 20 and 20' are hermetically sealed by any solder glass.

In this embodiment, the luminescent body set 26 which is coated on the board 20 is arranged in the rear of the electrodes 29 of the central plate 28 for the discharge space 22, and therefore, is farther than the electrodes 29 from the discharge space 22. Accordingly, ions produced at gas discharge are mostly trapped with the front electrodes 29 and do not reach to the rear luminescent body set 26.

Operation of the plasma display panel by an alternating current drive is described hereinafter. When any negative potential is supplied to one electrode member 29 of the board 20 while any positive potential is supplied to one stripe-like electrode 23 of the board 20', gas discharge occurs in a corresponding portion of discharge space 22. Ultraviolet rays produced by this gas discharge excite the luminescent body set 26 on the front glass plate 25 through the through hole 27. The luminescent body set 26 selected is luminous with its proper color.

On the other hand, ions produced by this discharge run toward the electrode 29 to which positive potential is supplied, but they impact over the area of the electrode 29 to be trapped on the dielectric layer 24. Free ions going toward the through hole 27 also occur at gas discharge, but they cannot pass through a void surrounded by the electrode 29. Therefore, free ions cannot reach the luminescent body set 26 in the rear of the electrode 29.

Bombardment of ions to the luminescent body set 26 is remarkably reduced in this structure, and it is possible to obtain a plasma panel of a long life time.

Referring to FIG. 3, plasma 32 due to a gas discharge is caused to occur in the space 22 between two boards 20 and 20'. Ions within plasma 32 don't reach to the luminescent body set 26 to be trapped at the dielectric layer 30 on the electrode 29, while ultraviolet rays 31 produced by gas discharge excite the luminescent body set 26 through the through hole 27 of the central plate 28. The excited luminescent body set 26 is luminous with its peculiar color due to radiation of the ultraviolet rays 31.

Referring to FIGS. 4(*a*) to 4(*h*), there are shown several variations of the electrode 29 mounted on the central plate 28.

In FIGS. 4(*a*) to 4(*d*), an electrode 29 of a conductive substance is coated symmetrically to conductive lines 34 and 35 extending from the electrode 29 around a through hole 27, while in FIGS. 4(*e*) to 4(*h*), the electrode 29 is coated asymmetrically. Conductive lines 34 and 35 extending downwardly and upwardly from the electrode 29 are connected to other electrodes to form an electrode member. Further, an inside region 33 of two broken lines represents a position of a stripe-like electrode member on the rear board, and therefore both of the electrode members on the front and rear boards cross each other through the discharge space.

The plasma display panel according to this invention has a long life time equal to about four or five times that of conventional devices shown in FIGS. 1(*a*) and 1(*b*), unless luminescence intensity is reduced to one half of the intial intensity. The luminescent body such as P15 or P1, etc which is luminous with green color is employed in this embodiment. The ionizable gas filled in space uses for example, neon, xenon, helium or a mixture of them, and the pressure of the ionizable gas is 200 Torr. The luminescent body such as ZnS or $CaWO_4$ of red or blue luminous color may be used as the luminescent one.

Referring to FIG. 5, red luminescent elements 26R, green ones 26G, and blue ones 26B are regularly arranged in the rear of the through holes 27 of the central plate 28. The electrodes 29 on a surface of the central plate 28 facing the discharge space are coated around the through holes 27. Stripe-like electrode members on another plate are arranged at regions 33. In this embodiment, a conductive region 35A having symmetrical electrodes 29 and conductive regions 35B having asymmetrical electrodes are formed on the central plate 28. Thus, the combination of the symmetrical and asymmetrical regions are effective at a space factor which is a problem in conventional multicolor plasma display panels. The order of three kinds of luminescent bodies should be regularly arranged in a predetermined pattern on the inside surface of front plate.

Both of two boards 20 and 20' are respectively covered with dielectric layers 24 and 30 on the inside surface in the embodiment, but only one of two boards may be covered with a dielectric layer.

This invention is applicable to color television display by regularly arranging luminescent bodies of three primary colors in a recurring pattern. Therefore, according to this invention, there is obtained a multicolor plasma display panel having a long life time.

What is claimed is:

1. A plasma display panel comprising a front board, a rear board spaced from the front board to define a discharge space therebetween, and an ionizable gas filling the discharge space, wherein the improvement comprises a front plate forming part of the front board and a luminescent layer set rendered luminous by excitation from ultraviolet rays affixed to the inside surface of the front plate, a central plate having a number of through holes mounted on the inside surface of the front plate over the luminescent layer set, and a plurality of first electrode members affixed about each of said through holes on an inside surface of said central plate, said electrodes being connected to each other by conductive lines, and said rear board including a rear plate having second electrode members affixed to the inside surface thereof corresponding to said through holes of the central plate.

2. The plasma display panel as set forth in claim 1, wherein said electrodes and conductive lines on said central plate and said second electrode members on said rear plate are covered by dielectric layers.

3. The plasma display panel as set forth in claim 1, wherein said luminescent layer set consists of three types of luminescent bodies that differ from each other in their respective luminous colors, the three types of luminescent bodies being independent of each other and being regularly arranged on said inside surface of said front plate.

4. The plasma display panel as set forth in claim 1, wherein each of said first electrode members are symmetrical with respect to said conductive lines.

5. The plasma display panel as set forth in claim 1, wherein each of said electrodes are asymmetrical with respect to said conductive lines.

6. The plasma display as set forth in claim 1, wherein said first electrode members consist of symmetrical and asymmetrical electrodes as to said conductive lines.

7. The plasma display panel as set forth in claim 1, wherein said first electrode members are substantially perpendicular to said second electrode members.

8. The plasma display panel as set forth in claim 1, wherein said electrodes and conductive lines on said central plate are coated with a dielectric layer.

9. The plasma display panel as set forth in claim 1, wherein said first and second electrode members are driven by an alternating current.

10. The plasma display panel as set forth in claim 9, wherein said luminescent layer set consists of three primary colors of luminescent bodies arranged on said inside surface of said front plate.

11. The plasma display panel as set forth in claim 9, wherein said first electrode members include both symmetrical and asymmetrical electrodes with respect to said conductive lines, and are substantially perpendicular to said second electrode members.

12. The plasma display panel as set forth in claim 11, wherein said electrodes and conductive lines on said central plate are coated with a dielectric layer.

13. The plasma display panel as set forth in claim 12, wherein said second electrode members on said rear plate are covered by a dielectric layer.

* * * * *